United States Patent [19]

Franklin

[11] Patent Number: 4,973,223

[45] Date of Patent: Nov. 27, 1990

[54] VARIABLE GEOMETRY TURBINE

[75] Inventor: Philip C. Franklin, Huddersfield, United Kingdom

[73] Assignee: Holset Engineering Company, Ltd., England

[21] Appl. No.: 352,095

[22] Filed: May 15, 1989

[30] Foreign Application Priority Data

May 17, 1988 [GB] United Kingdom ..... 8811623

[51] Int. Cl.[5] ..... F04D 29/56; F04D 27/00; F04D 27/02

[52] U.S. Cl. ..... 415/157; 415/151; 415/148

[58] Field of Search ..... 415/148, 150, 151, 157, 415/159, 165

[56] References Cited

U.S. PATENT DOCUMENTS

| | | | |
|---|---|---|---|
| 1,322,810 | 11/1919 | Moody | 415/157 |
| 1,656,012 | 1/1928 | Nagler | 415/157 |
| 2,846,185 | 8/1958 | Widmer | 415/150 |
| 2,861,774 | 11/1958 | Buchi | 415/150 |
| 2,996,996 | 8/1961 | Jassniker | 415/150 |
| 3,610,770 | 10/1971 | Hendriks | 415/151 |
| 4,403,914 | 9/1983 | Rogo et al. | 415/150 |
| 4,657,481 | 4/1987 | Mowill et al. | 415/151 |
| 4,802,817 | 2/1989 | Tyler | 415/157 |

FOREIGN PATENT DOCUMENTS

| | | | |
|---|---|---|---|
| 0134748 | 3/1985 | European Pat. Off. . | |
| 0131104 | 10/1979 | Japan | 415/157 |
| 8603809 | 7/1986 | PCT Int'l Appl. | 415/148 |
| 691144 | 5/1953 | United Kingdom . | |
| 1473248 | 5/1977 | United Kingdom . | |

*Primary Examiner*—Edward K. Look
*Assistant Examiner*—Hoang Nguyen
*Attorney, Agent, or Firm*—Pravel, Gambrell, Hewitt, Kimball & Krieger

[57] ABSTRACT

A variable geometry turbine in which an inlet passageway has a movable wall the position of which is adjusted to match the turbine characteristics to the flow rate through the turbine. Nozzle vanes extend through the movable wall and are mounted on a nozzle support which is normally stationary so that the nozzles contact the facing wall of the inlet passageway. The nozzle support is arranged to move with the movable wall however when the movable wall opens the inlet passageway beyond a predetermined extent so that the nozzle vanes are at least partially retracted when the movable wall is in the fully open position.

5 Claims, 6 Drawing Sheets

VARIABLE GEOMETRY TURBINE

The present invention relates to a variable geometry turbine, and in particular to a turbine of a type suitable for use in a turbocharger for an internal combustion engine.

Variable geometry turbines are well known and generally comprise a turbine chamber within which a turbine wheel is mounted, an annular inlet passageway arranged around the turbine chamber, an inlet chamber arranged around the inlet passageway, and an outlet passageway extending from the turbin chamber, the passageways and chambers communicating such that pressurised gas admitted to the inlet chamber flows through the inlet passageway to the outlet passageway via the turbine chamber. One wall of the inlet passageway is defined by a movable wall member the position of which relative to a facing wall of the inlet passageway is adjustable to control the width of the inlet passageway. The inlet passageway width and thus the geometry of the turbine is varied so that as the volume of gas flowing through the turbine decreases the inlet passageway width is also decreased to maintain gas velocity and hence turbine efficiency.

It is also known to place nozzle vanes in the inlet passageway so as to deflect gas flowing through the inlet passageway in a direction which optimises the turbine efficiency. The provision of such vanes reduces the effective area of the turbine so that the maximum gas flow rate through the turbine is less than would be possible if the vanes were not present. Furthermore, the provision of the vanes makes it more difficult to provide a reliable and effective variable geometry structure.

An example of a known variable geometry assembly is described in British Patent Specification GB-A-874085. In this arrangement one wall of the inlet passageway supports fixed vanes and the other wall supports slots into which those vanes fit when the passageway width is reduced to a minimum. When the passageway width is increased to a maximum the vanes do not extend across the full width of that passageway.

Other variable geometry structures are described in for example U.S. Pat. No. 4,292,807, and British Patent Specification Nos. GB-A-1138941 and GB-A-2044860. These specifications describe various arrangements in which vanes project across the full width of the inlet passageway into sockets provided on the facing passageway wall. Such an arrangement ensures that the vanes extend across the full width of the passageway even when the passageway is fully open, but the sockets define recesses within which contaminants can build up, increasing the risk of jamming.

European Patent Specification No. EP-A-0080810 describes another variable geometry arrangement in which the vanes extend through slots in a movable wall member fabricated from a sheet material. Thus the vanes do not move as the wall member moves and the vanes always extend across the full width of the inlet passageway.

As mentioned above, the presence of vanes in the inlet passageway reduces the maximum effective area of the turbine stage. There are therefore circumstances in which it would be useful to be able to remove the vanes from the inlet passageway. It is however more important to be able to adjust the inlet passageway width to increase the effective operating range of the turbine, and difficulties have been experienced in producing reliable structures which enable the variation of this basic geometrical feature of turbines. The addition of a further mechanism capable of moving the inlet passageway vanes in addition to one wall of the inlet passageway clearly introduces the probability of yet more reliability problems. Furthermore, the available space for such a mechanism is very limited.

It is an object of the present invention to provide an improved variable geometry turbine which obviates or mitigates the problems outlined above.

According to the present invention there is provided a variable geometry turbine comprising a turbine wheel mounted in a turbine chamber, an annular inlet passageway arranged around the turbine chamber, an inlet chamber arranged around the inlet passageway, and an outlet passageway extending from the turbine chamber, the passageways and chambers communicating such that pressurised gas admitted to the inlet chamber flows through the inlet passageway to the outlet passageway via the turbine chamber, wherein one wall of the inlet passageway is defined by a moveable annular wall member the position of which relative to a facing wall of the inlet passageway is adjustable to control the width of the inlet passageway, and nozzle vanes extend through slots in the annular wall member across the inlet passageway, characterised in that the nozzle vanes extend from a movable nozzle support located on the side of the annular wall member remote from the inlet passageway, the nozzle support being arranged such that free end of the vanes extend into abutment with the said facing wall when the annular wall member is located at a distance from the said facing wall less than a predetermined distance, and such that the nozzle support moves with the annular member when the annular wall member is located at a distance from the said facing wall greater than the said predetermined distance, whereby the free ends of the nozzle vanes move away from the said facing wall as the annular wall member moves away from the said facing wall beyond the said predetermined position.

Preferably the annular wall member is movable to a fully open position in which the gap between it and the said facing wall is greater than the spacing between the said facing wall and an imaginary surface forming a continuation of the wall of the inlet passageway adjacent to and downstream from the annular wall member. The said gap in the fully open position may be approximately $1\frac{2}{3}$ times greater than the said spacing between the facing wall and the imaginary surface.

The location of the predetermined position relative to the turbine assembly may be such that the said gap is greater than the said spacing when the annular member is in the said predetermined position. The gap may be for example $1\frac{1}{3}$ times greater than the said spacing when the annular member is in the said predetermined position.

An embodiment of the present invention will now be described, by way of example, with reference to the accompanying drawings, in which.

Figure 1:
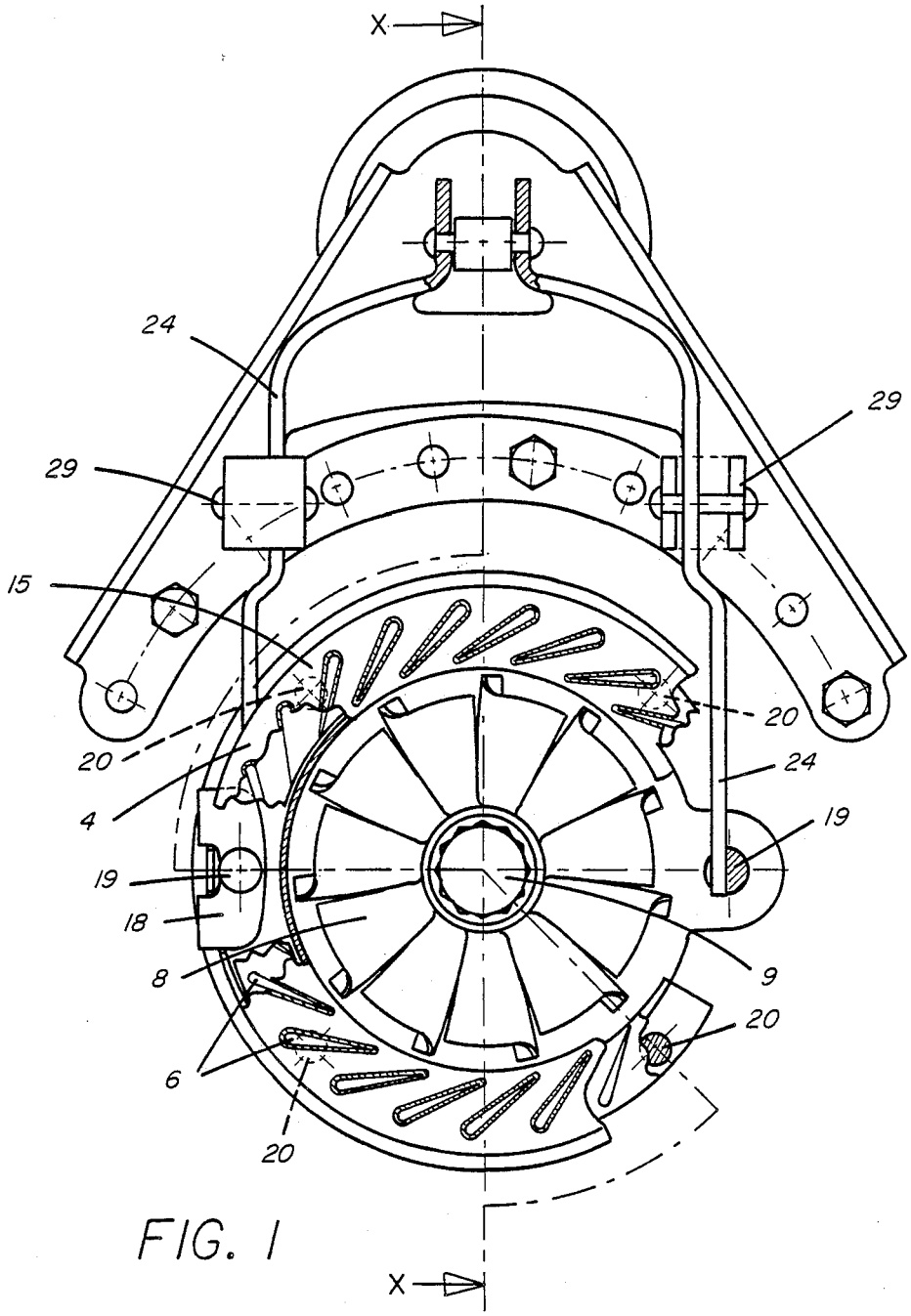
FIG. 1 is a cut-away view looking along the axis of a variable geometry turbine in accordance with the present invention, the view showing axially spaced features of the turbine.

Referring now to FIGS. 1 to 4, the illustrated variable geometry turbine comprises a turbine housing 1 defining a volute or inlet chamber 2 to which exhaust gas from an internal combustion engine (not shown) is delivered. The exhaust gas flows from the inlet chamber 2 to an outlet passageway 3 via an inlet passageway defined on one side by a movable annular member 4 and on the other side by a wall 5 which faces the movable annular wall member 4. An array of nozzle vanes 6 supported on a nozzle support ring 7 extends across the inlet passageway. Gas flowing from the inlet passageway 2 to the outlet passageway 3 passes over a turbine wheel 8 and as a result a torque is aplied to a turbocharger shaft 9 which drives a compressor wheel 10. Rotation of the wheel 10 pressurises ambient air present in an air inlet 11 and delivers the pressurised air to an air outlet or volute 12. That pressurised air is fed to the internal combustion engine (not shown).

The movable annular wall member 4 is contacted by a sealing ring 13 and comprises a radially inner tubular wall 14, a radially extending annular portion 15 which defines slots through which the vanes 6 extend, a radially outer tubular portion 16 which bears against the sealing ring 13, and a radially extending flange 17. The radially outer tubular portion 16 is engaged by two diametrically opposed members 18 which are supported on respective guide pins 19.

The nozzle support 7 is mounted on an array of four guide pins 20 so as to be movable parallel to the axis of rotation of the turbocharger. Each of the guide pins 20 is biased by a compression spring 21 towards the right in FIGS. 2 to 4. Thus the nozzle support 7 and the vanes mounted on it are biased towards the right in FIGS. 2 to 4 and accordingly normally assume the position shown in FIG. 2, with the free ends of the vanes 6 bearing against the facing wall 5 of the inlet passageway.

Figure 2:
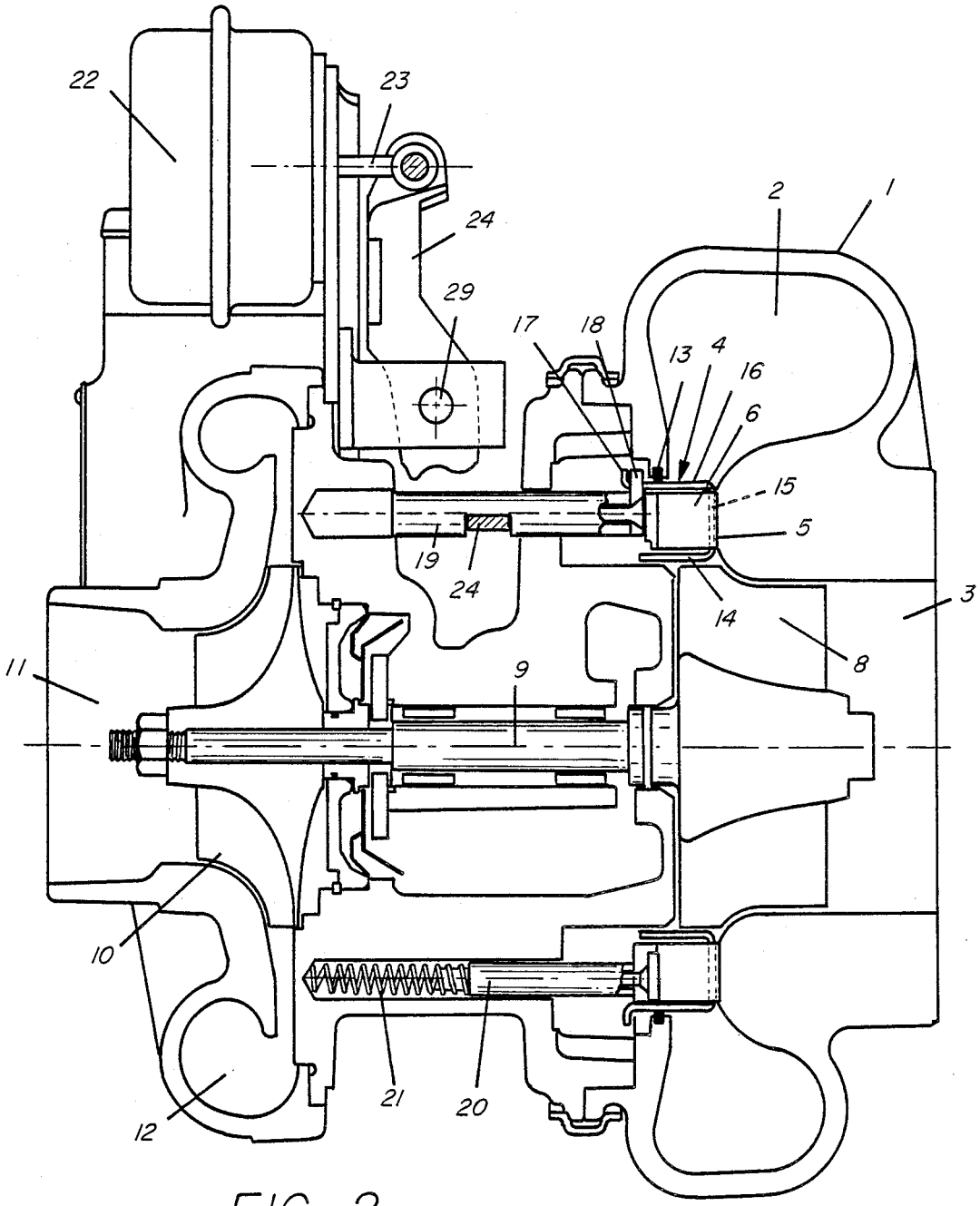
FIGS. 2, 3 and 4 are sectional views taken on the line X—X of FIG. 1 with compnents of the assembly of FIG. 1 shown respectively in the fully closed, half closed and fully open positions.
Figure 3:
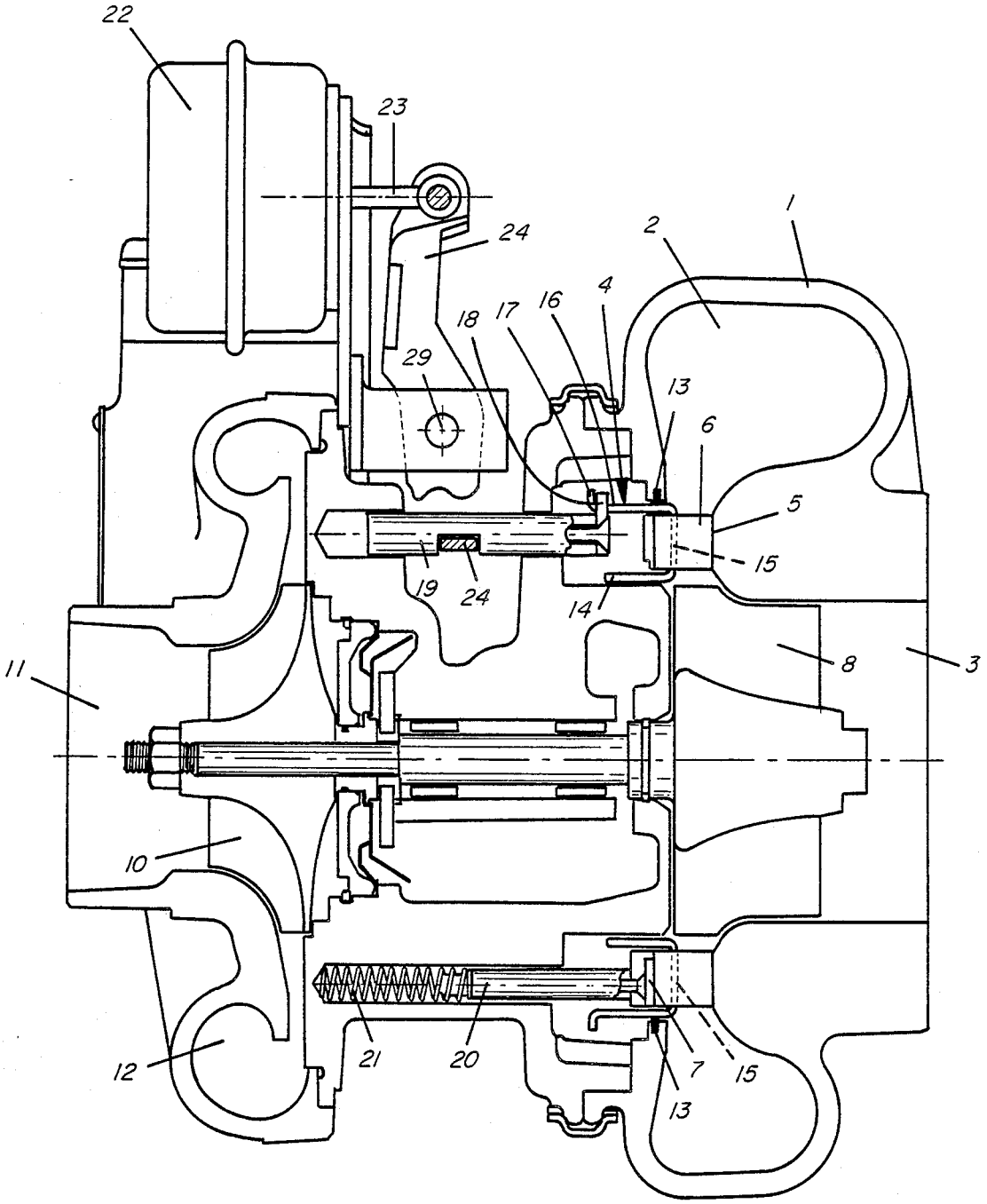
Figure 4:
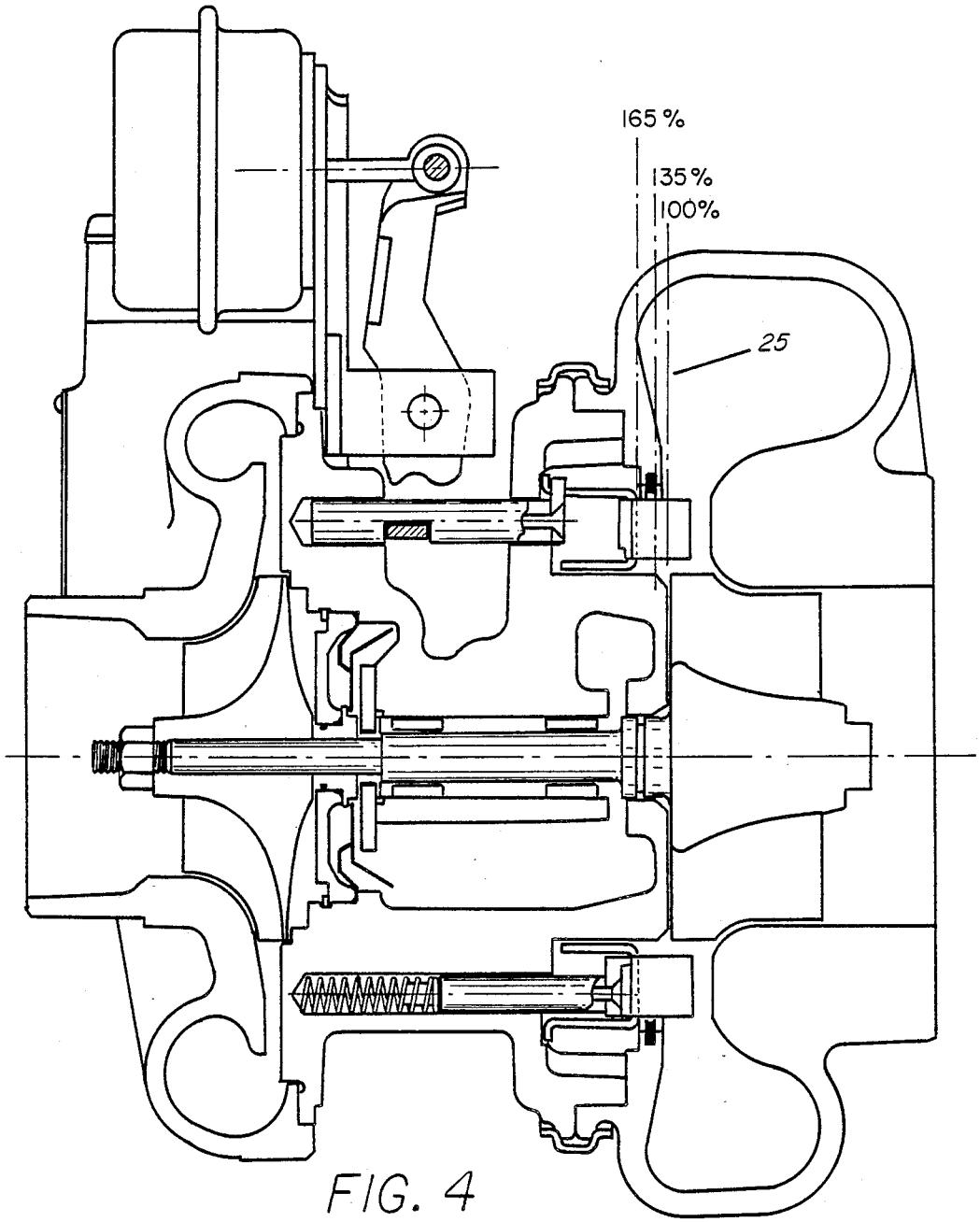

A pneumatically operated actuator 22 is operable to control the position of an output shaft 23 that is linked to a stirrup member 24 that engages each of the guide pins 19. Thus by controlling the actuator 22 the axial position of the guide pins 19 and thus of the movable annular wall member 4 can be controlled. FIG. 2 shows the movable annular wall member in its fully closed position in which the radially extending portion 15 of the member abuts the facing wall 5 of the inlet passageway. FIG. 3 shows the annular wall member 4 in a half open position and FIG. 4 shows the annular wall member 4 in a fully open position. As the actuator 22 is positioned at a considerable distance from the turbines axis, space is not a problem. Furthermore, the precise radial position of the actuator shaft 23 is not critical, allowing tolerances to be increased. Equally radial expansion due to thermal distortion is not a critical problem.

Referring to FIG. 4, a dotted line 25 indicates an imaginary surface which is coplanar with the end surface of the turbine housing the downstream side of the movable member 4 and adjacent which the turbine wheel 8 is positioned. This surface in effect defines one side of the inlet passageway to the turbine chamber. When the wall of the inlet passageway defined by the movable annular wall member 4 is aligned with the imaginary surface 25 the spacing between the annular wall member 4 and the facing wall 5 is for the purposes of the present description deemed to correspond to the inlet width of the inet passageway downstream of the vanes 6. This condition is referred to below as 100% of nominal inlet width. When the movable annular wall member 4 is in the "100% of nominal inlet width" position the vanes 6 are still in contact with the facing wall 5. As the annular wall member 4 moves further away from the facing wall 5 the gap between the rear face of the annular wall member 4 and the nozzle support 7 is reduced until the two come into contact. This occurs when the spacing between the annular wall member and the facing surface 5 corresponds to 135% of the nominal inlet passageway inlet width. Further movement of the annular wall member 4 away from the facing wall 5 results in the nozzle support 7 moving with the annular wall member 4. Accordingly, the free ends of the vanes 6 are pulled back from the facing wall 5 and a gap therefore develops in the inlet passageway between the free ends of the vanes and the facing wall. This increases the effective area of the inlet passageway. When the annular wall member 4 is fully retracted (FIG. 4) its position corresponds to 165% of the nominal inlet passageway width.

Figure 5:
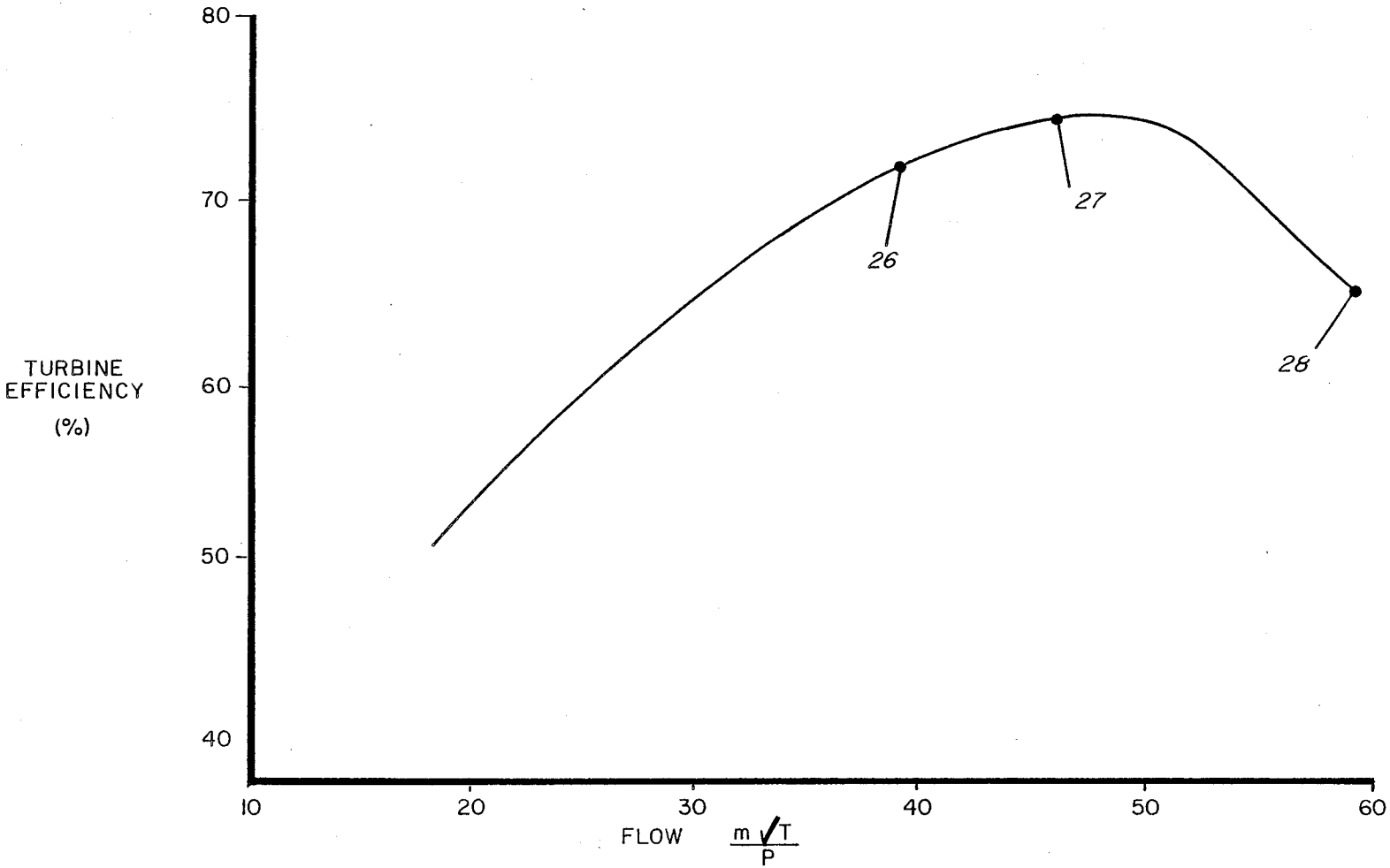
FIG. 5 is a representation of the relationship between turbine efficiency and mass flow through the turbine of FIG. 1, at a constant expansion ratio.

Referring now to FIG. 5, this illustrates the effect on turbine efficiency of movements of the annular wall member 4 and the nozzle support 7. The point on the curve corresponding to 100% of nominal inlet width in indicated by number 26. The points on the curve corresponding to 135% opening and 165% opening are indicated by numerals 27 and 28 respectively. Thus it can be seen that by providing for the annular wall member 4 to open well beyond the nominal 100% position and by providing for partial retraction at least of the nozzle vanes the operational characteristics of the turbine can be modified to increase the proportion of those operating characteristics which lie within a high efficiency region of the performance curve. Essentially, for a given flow range (corresponding to a fixed distance parallel to the flow axis) the ability to extend the characteristic curve to point 28 increases the mean turbine efficiency by avoiding operating the turbine in the less efficient region indicated by the left-hand of the curve in FIG. 5.

Figure 6:
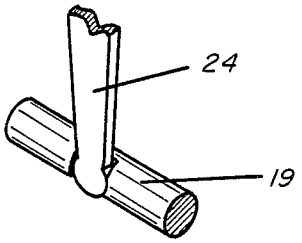
FIG. 6 illustrates the interrelationship between guide pins supporting a movable wall member of the arrangement of FIGS. 1 to 4 and a stirrup member which controls the position of those guide pins.

Referring now to FIG. 6, this shows the interengagement between the stirrup 24 and one of the guide pins 19 upon which the movable annular wall member 4 is mounted. The two ends of the stirrup 24 engage in slots cut in side surfaces of pins 19. The edges of the stirrup ends which bear against the ends of the slots are curved so that the clearance between each stirrup end and the slot ends is constant. The stirrup 24 is pivoted on pivot pins 29 so that the stirrup 24 forms a level which can be moved to precisely position the pins 19. The stirrup 24 is formed from sheet steel arranged such that the stirrup is relatively stiff in the direction parallel to the axis of pins 19 but relatively flexible perpendicular to the pins. Thus transverse forces on the pins 19 are minimised, thereby reducing the probability of the pins 19 jamming in the bearings within which they slide. Furthermore, as the stirrup 24 engages central portions of the pins 19 the bearings in which the pins 19 are mounted are relatively widely spaced.

Figure 7:
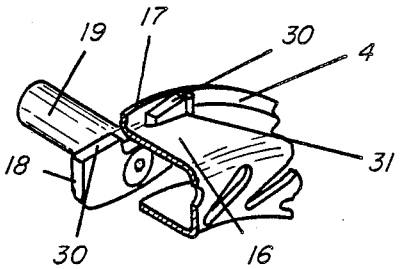
FIG. 7 illustrates the interrelationship between a guide pin of the type illustrated in FIG. 6 and a movable wall member.

FIG. 7 illustrates the interengagement between the guide pins 19 and the annular wall member 4. The member 4 is exposed to large variations in temperature and pressure and can accordingly distort to a certain degree. If the linkage between the member 4 and the pin 19 was rigid such distortion would apply significant transverse forces to the pins 19. Accordingly the engagement between the member 4 and 19 is such that distortion of the member 4 can be accommodated without applying transverse forces to the pin.

As shown in FIG. 7 this is achieved by rigidly mounting a bridge link plate 18 on the end of each pin 19. Two legs 30 of the bridge link engage in slots 31 defined in the tubular portion 16 of the member 4 adjacent the flange 17. The result is a structure which is adequately rigid in the direction of the axis of the pins 19 to ensure close control of the axial position of the member 4 but which is sufficiently loose in the radial and circumferential directions to accommodate thermal distortions of the member 4. The member 4 is in effect located on the vanes 6 and thus the member 4 is maintained in position despite its relatively loose mounting.

The bridge links 18 can be thicker than the flange 17 to maintain a stiff joint in the axial direction, and the width of the links 18 maintains a good resistance to tilting of the member 4 relative to the turbine axis.

Figure 8:
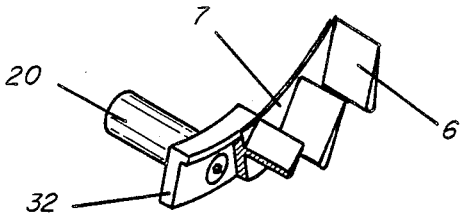
FIG. 8 illustrates the mounting of a nozzle vane support ring incorporated in the arrangement of FIGS. 1 to 4.
Figure 1:
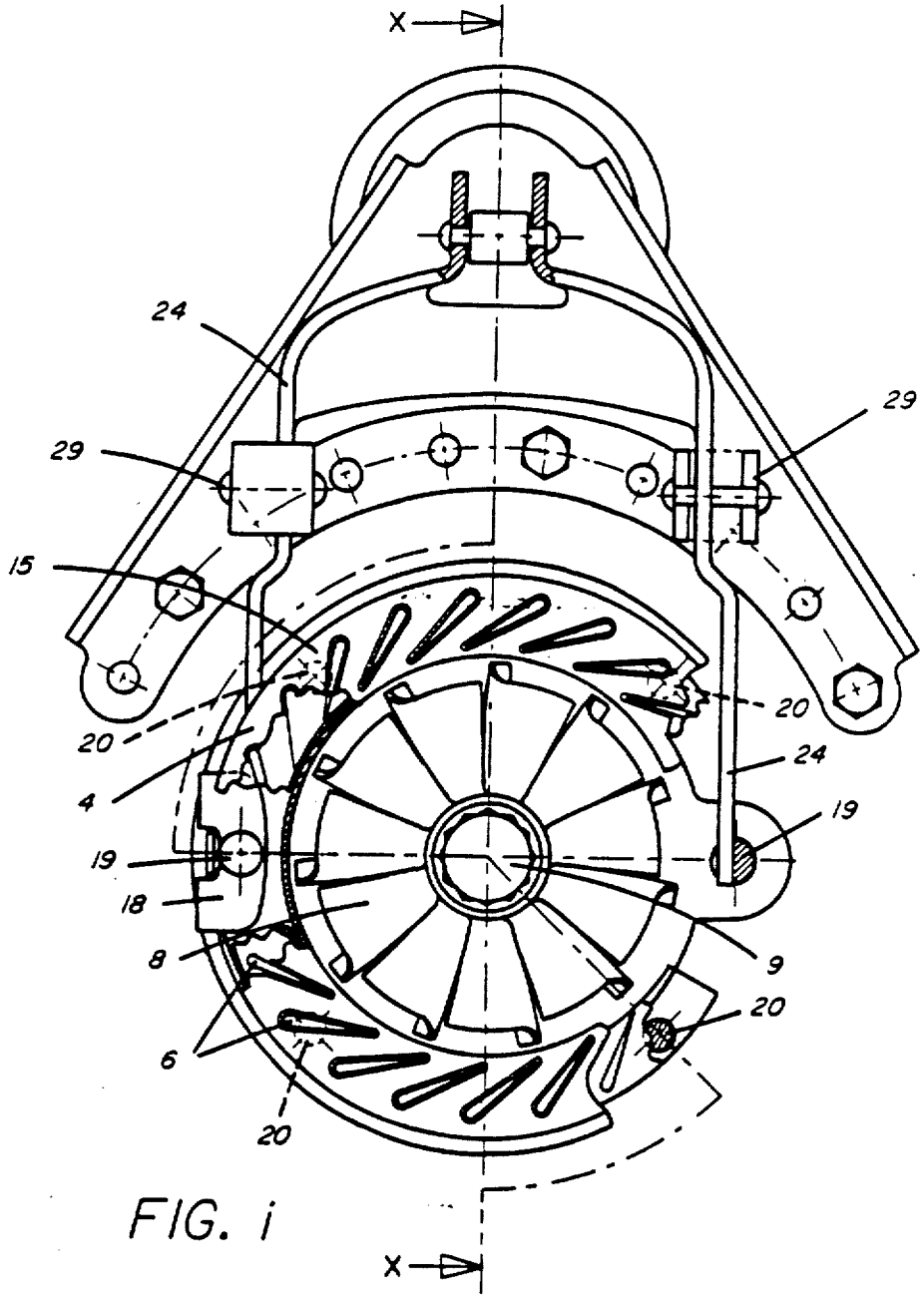
Figure 2:
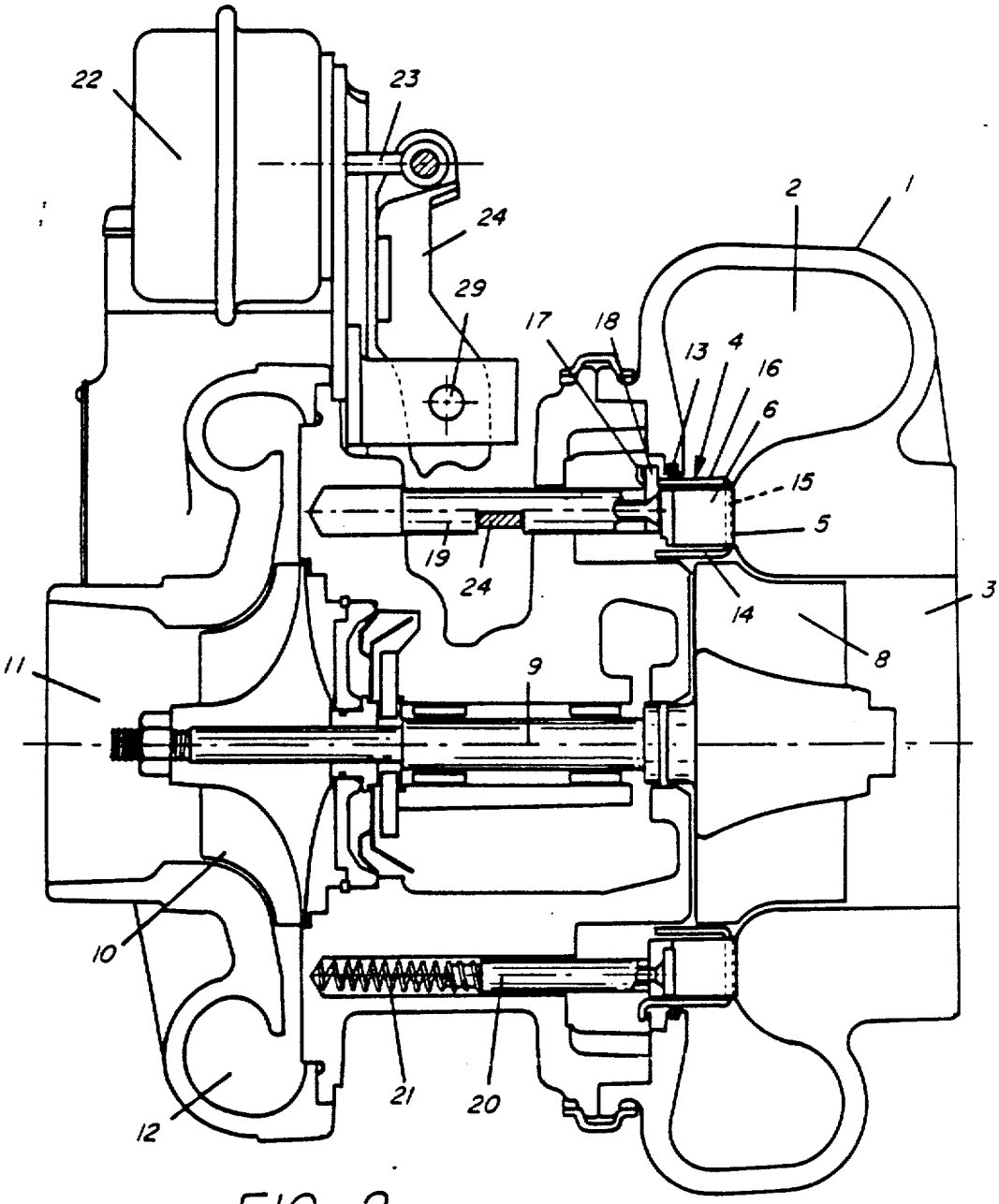
Figure 3:
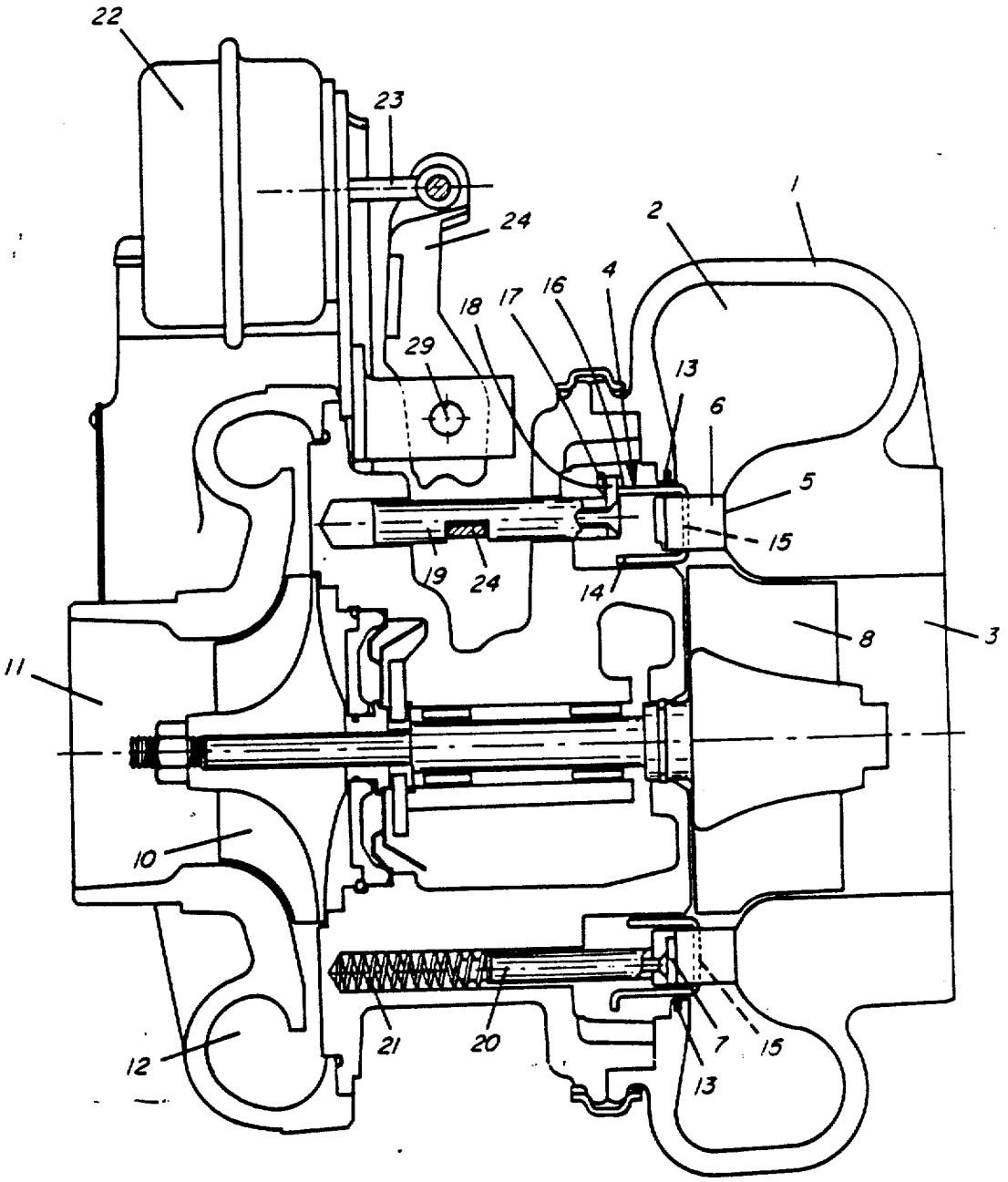
Figure 4:
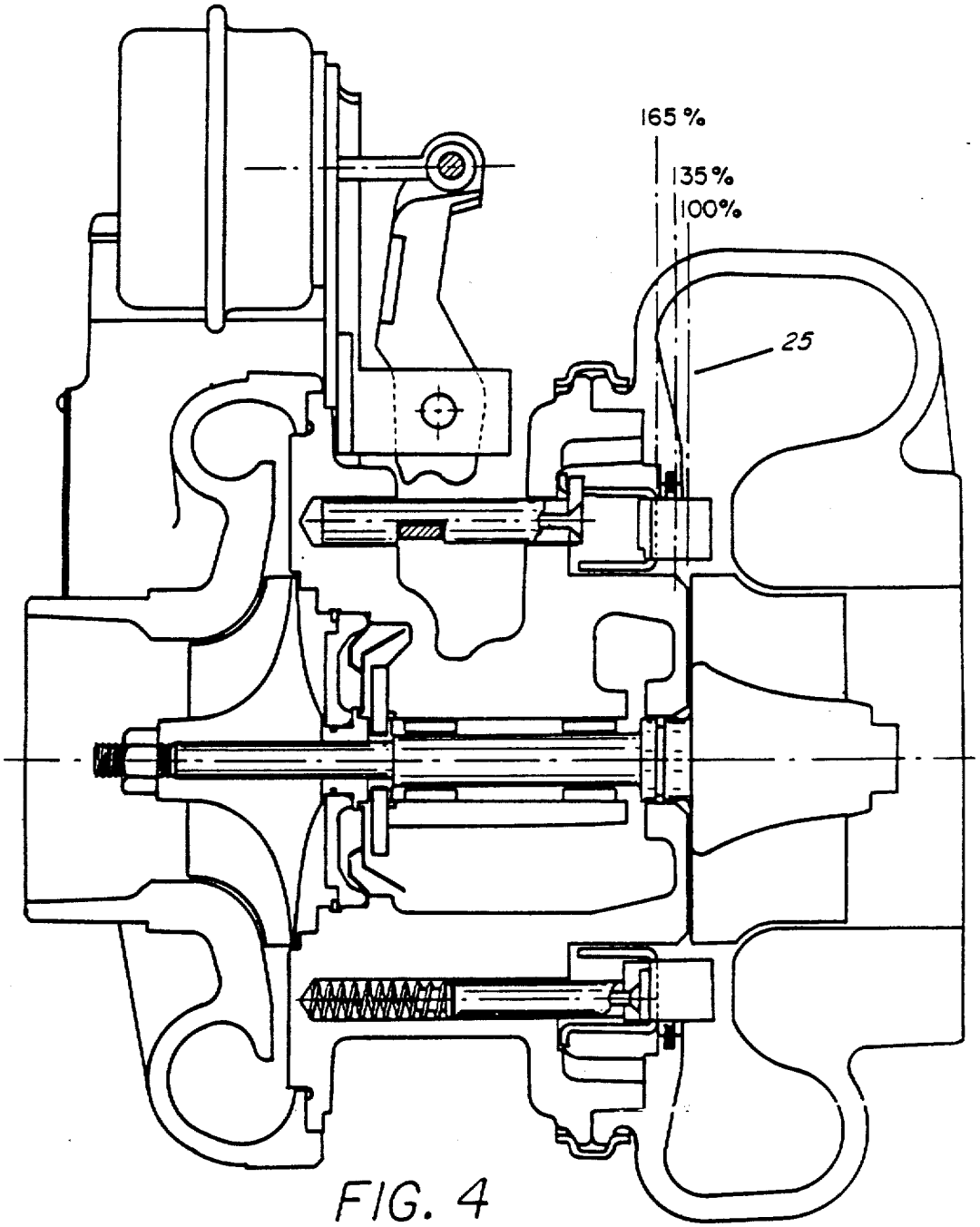
Figure 5:
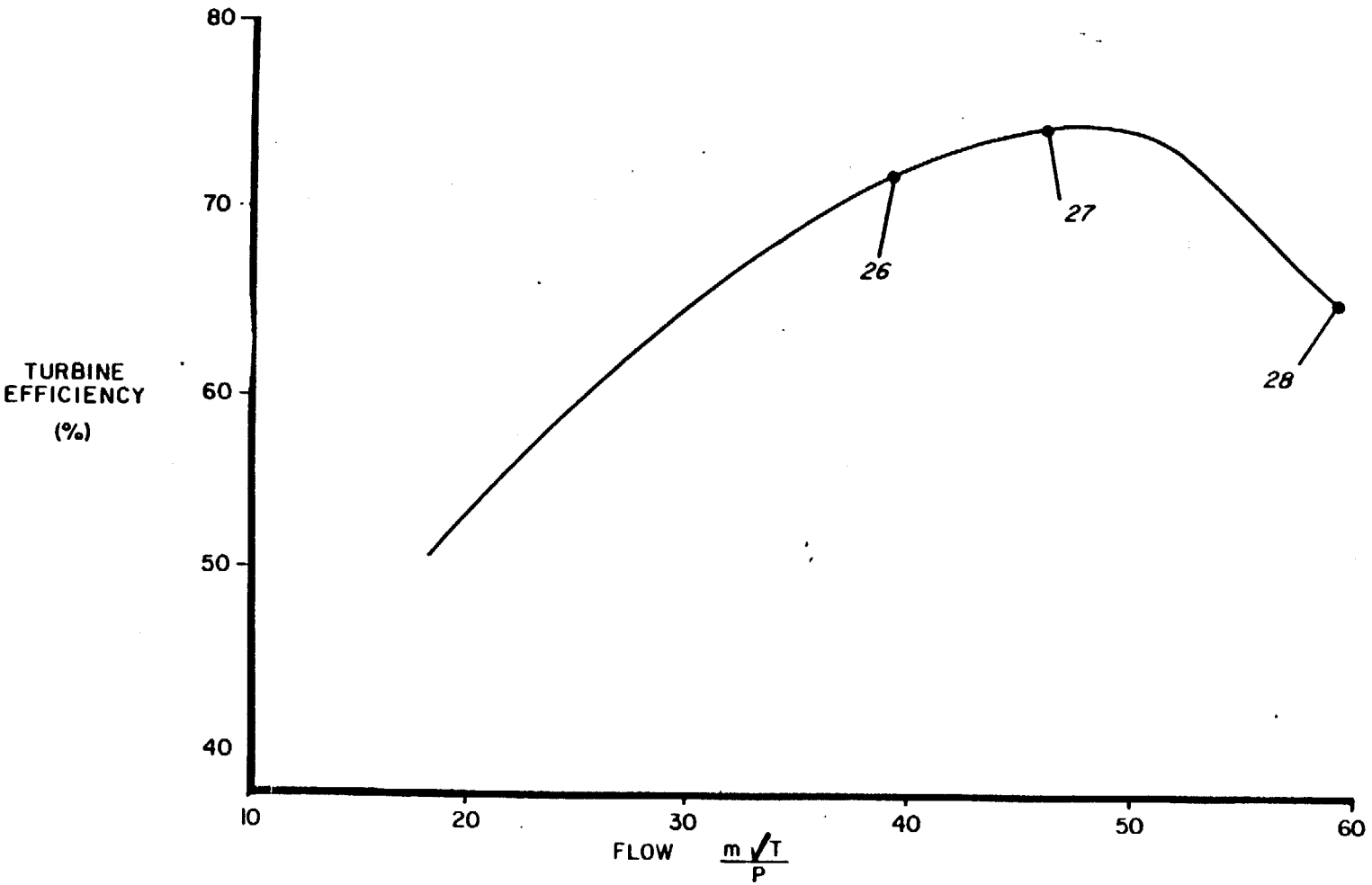
Figure 6:
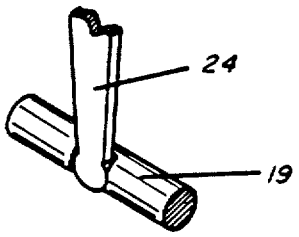
Figure 7:
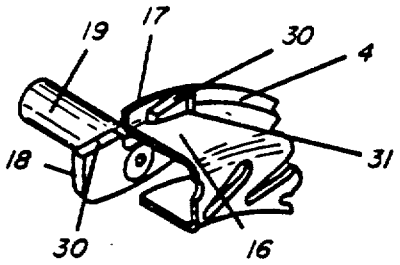
Figure 8:
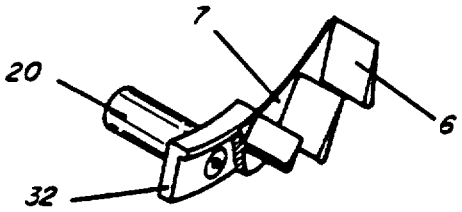

Referring now to FIG. 8, this illustrates the interrelationship between the spring biased support pins 20 and the nozzle support 7 on which the vanes 6 are mounted. Each pin 20 has rigidly mounted on its end a bracket 32 which has a flat surface engaging the rear side of the nozzle support ring 7 and an inner edge which is flanged to engage inside the radially inner edge of the nozzle support ring 7.

The illustrated arrangement comprises a single annular seal 13 arranged around the radially outer side of the movable wall member 4. Alternative sealing arrangements are possible, however, for example a pair of seals arranged respectively on the radially inner and outer portions of the movable annular wall member 4.

I claim:

1. A variable geometry turbine comprising a turbine wheel mounted in a turbine chamber, an annular inlet passageway arranged around the turbine chamber, an inlet chamber arranged around the inlet passageway, and an outlet passageway extending from the turbine chamber, the passageways and chambers communicating such that pressurised gas admitted to the inlet chamber flows through the inlet passageway to the outlet passageway via the turbine chamber, wherein one wall of the inlet passageway is defined by a movable annular wall member the position of which relative to a facing wall of the inlet passageway is adjustable to control the width of the inlet passageway, and nozzle vanes extend through slots in the annular wall member across the inlet passageway, characterised in that the nozzle vanes extend from a movable nozzle support located on the side of the annular wall member remote from the inlet passageway, the nozzle support being arranged such that free ends of the vanes extend into abutment with the said facing wall when the annular wall member is located at a distance from the said facing wall less than a predetermined distance, and such that the nozzle support moves with the annular member when the annular wall member is locted at a distance from the said facing wall greater than the said predetermined distance, whereby the free ends of the nozzle vanes move away from the said facing wall as the annular wall member moves away from the said facing wall beyond the said predetermined position.

2. A variable geometry turbine according to claim 1, wherein the annular wall member is movable to a fully open position in which the gap between it and the said facing wall is greater than the spacing between the said facing wall and an imaginary surface forming a continuation of the wall of the inlet passageway adjacent to and downstream from the annular wall member.

3. A variable geometry turbine according to claim 2, wherein the said gap in the fully open position is approximately $1\frac{2}{3}$ times greater than the said spacing between facing wall and the imaginary surface.

4. A variable geometry turbine according to claim 2 or 3, wherein the said gap when the annular member is in the said predetermined position is greater than the said spacing.

5. A variable geometry turbine according to claim 4, wherein the said gap when the annular member is in the said predetermined position is approximately $1\frac{1}{3}$ times greater than the said spacing.

* * * * *

UNITED STATES PATENT AND TRADEMARK OFFICE

CERTIFICATE OF CORRECTION

PATENT NO. : 4,973,223

DATED : November 27, 1990

INVENTOR(S) : Philip C. Franklin

It is certified that error appears in the above-identified patent and that said Letters Patent is hereby corrected as shown below:

The title page, showing the illustrative figure, should be deleted to be replaced with the attached title page.

Drawing Sheets 1-6 should be deleted to be replaced with Drawing Sheets 1-6, consisting of Figs. 1-8, as shown on the attached pages.

Signed and Sealed this

Fourteenth Day of July, 1992

*Attest:*

DOUGLAS B. COMER

*Attesting Officer*

*Acting Commissioner of Patents and Trademarks*

United States Patent [19]

Franklin

[11] Patent Number: 4,973,223

[45] Date of Patent: Nov. 27, 1990

[54] VARIABLE GEOMETRY TURBINE

[75] Inventor: Philip C. Franklin, Huddersfield, United Kingdom

[73] Assignee: Holset Engineering Company, Ltd., England

[21] Appl. No.: 352,095

[22] Filed: May 15, 1989

[30] Foreign Application Priority Data

May 17, 1988 [GB] United Kingdom ..... 8811623

[51] Int. Cl.[5] ..... F04D 29/56; F04D 27/00; F04D 27/02

[52] U.S. Cl. ..... 415/157; 415/151; 415/148

[58] Field of Search ..... 415/148, 150, 151, 157, 415/159, 165

[56] References Cited

U.S. PATENT DOCUMENTS

| | | | |
|---|---|---|---|
| 1,322,810 | 11/1919 | Moody | 415/157 |
| 1,656,012 | 1/1928 | Nagler | 415/157 |
| 2,846,185 | 8/1958 | Widmer | 415/150 |
| 2,861,774 | 11/1958 | Buchi | 415/150 |
| 2,996,996 | 8/1961 | Jassniker | 415/150 |
| 3,610,770 | 10/1971 | Hendriks | 415/151 |
| 4,403,914 | 9/1983 | Rogo et al. | 415/150 |
| 4,657,481 | 4/1987 | Mowill et al. | 415/151 |
| 4,802,817 | 2/1989 | Tyler | 415/157 |

FOREIGN PATENT DOCUMENTS

| | | | |
|---|---|---|---|
| 0134748 | 3/1985 | European Pat. Off. . | |
| 0131104 | 10/1979 | Japan | 415/157 |
| 8603809 | 7/1986 | PCT Int'l Appl. | 415/148 |
| 691144 | 5/1953 | United Kingdom . | |
| 1473248 | 5/1977 | United Kingdom . | |

*Primary Examiner*—Edward K. Look
*Assistant Examiner*—Hoang Nguyen
*Attorney, Agent, or Firm*—Pravel, Gambrell, Hewitt, Kimball & Krieger

[57] ABSTRACT

A variable geometry turbine in which an inlet passageway has a movable wall the position of which is adjusted to match the turbine characteristics to the flow rate through the turbine. Nozzle vanes extend through the movable wall and are mounted on a nozzle support which is normally stationary so that the nozzles contact the facing wall of the inlet passageway. The nozzle support is arranged to move with the movable wall however when the movable wall opens the inlet passageway beyond a predetermined extent so that the nozzle vanes are at least partially retracted when the movable wall is in the fully open position.

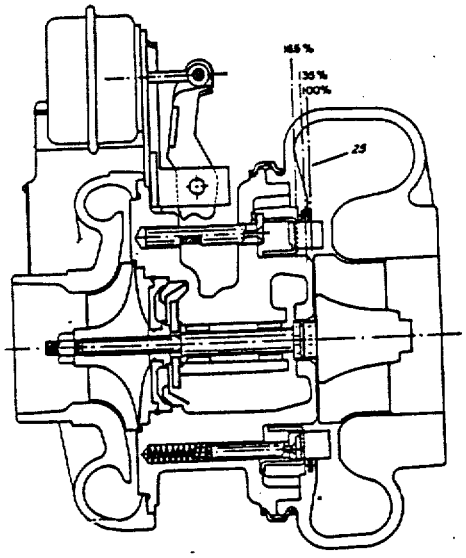

5 Claims, 6 Drawing Sheets